United States Patent [19]

Bell

[11] Patent Number: 4,570,540

[45] Date of Patent: Feb. 18, 1986

[54] LOVA TYPE BLACK POWDER PROPELLANT SURROGATE

[75] Inventor: Frank H. Bell, Logan, Utah

[73] Assignee: Morton Thiokol, Inc., Chicago, Ill.

[21] Appl. No.: 639,037

[22] Filed: Aug. 9, 1984

[51] Int. Cl.[4] ..... C06B 45/10

[52] U.S. Cl. ..... 102/202; 102/275.9; 149/19.7; 149/61

[58] Field of Search ..... 149/19.1, 19.4, 19.9, 149/19.7, 61; 102/202, 275.9

[56] References Cited

U.S. PATENT DOCUMENTS

| | | | |
|---|---|---|---|
| 1,819,456 | 8/1931 | Dehn | 149/61 |
| 2,496,815 | 2/1950 | Ringer | 149/19.7 |
| 2,700,603 | 1/1955 | Hart et al. | 149/19.1 |
| 2,841,481 | 7/1958 | Hall | 149/19.1 |
| 2,966,405 | 12/1960 | Sloan et al. | 149/61 |
| 2,988,438 | 6/1961 | Allovio | 149/19.7 |
| 2,988,876 | 6/1961 | Walden | 102/202 |
| 2,997,376 | 8/1961 | Bartley | 149/19.1 |
| 3,020,181 | 2/1962 | Proell | 149/19.7 |
| 3,779,825 | 12/1973 | Blackwell | 149/19.1 |
| 3,945,202 | 3/1976 | Marion et al. | 149/19.9 |
| 4,497,676 | 2/1985 | Kurtz | 149/61 |

FOREIGN PATENT DOCUMENTS

| | | | |
|---|---|---|---|
| 984960 | 3/1965 | United Kingdom | 149/19.4 |
| 1344609 | 1/1974 | United Kingdom | 149/19.1 |

*Primary Examiner*—Edward A. Miller

*Attorney, Agent, or Firm*—Richard J. Sheridan; George F. Wheeler; Gerald K. White

[57] ABSTRACT

Low explosive compositions which are more energetic than black powder while at the same time having LOVA characteristics are provided. These compositions contain about 45% to about 66% by weight of a metallic nitrate, the balance being cellulose acetate.

12 Claims, No Drawings

LOVA TYPE BLACK POWDER PROPELLANT SURROGATE

BACKGROUND OF THE INVENTION (1) Field of the Invention

The present invention relates to low explosive compositions comprising about 45% to about 66% of a metallic nitrate, the balance being cellulose acetate, the percentages being by weight based on total composition weight. The invention further relates to igniters for ordnance devices such as artillery cartridges, grenades, land or sea mines and the like.

(2) Description of the Prior Art

A continuing objective in the design of ammunition, particularly for military use, is to provide an ammunition propellant that is energetic when used, but which displays low vulnerability to heat, flame, impact, friction and chemical action. This is especially important in confined quarters such as inside tanks, ships or the like.

To try to meet this objective, the so-called Low Vulnerability Ammunition (LOVA) propellants have been developed. These propellants typically contain about 75 to 80% by weight of a crystaline high explosive and about 20% to 25% by weight for an inert polyurethane binder. Typical high explosives used in LOVA propellants are cyclotetramethylenetetranitramine (HMX) and cyclotrimethylenetrinitramine (RDX).

Black powder, composed of sulphur, charcoal and a metallic nitrate, has been used for igniters, boosters, fuze trains, squibs, bursting charges and the like for hundreds of years. However, it has several severe drawbacks. It is a Department of Transportation Class A (Solid) explosive which makes shipping difficult. Also, it is difficult to control in manufacture and extremely hazardous to manufacture.

One use of black powder has been as an igniter for the propellant in artillery shells and the like. Quite often the propellant to be ignited is a LOVA propellant. Unfortunately, black powder is not a completely satisfactory igniter for LOVA propellants because it does not have low vulnerability characteristics itself.

Accordingly, it would be highly desirable to provide an explosive which is a substitute for black powder and which would be more energetic than black powder as an igniter, while at the same time exhibiting less vulnerability. The present invention provides such an explosive.

SUMMARY OF THE INVENTION

In accordance with the present invention there is provided an explosive or propellant composition comprising about 45% to about 66% metallic nitrate, the balance being cellulose acetate, the percentages being by weight based on the total composition weight. The compositions of this invention are useful as substitutes for black powder, especially where Low Vulnerability Ammunition (LOVA) propellant characteristics are required.

Also in accordance with the present invention there are provided improved ordnance devices which contain an igniter comprising an explosive or propellant composition comprising about 45% to about 66% metallic nitrate, the balance being cellulose acetate, the percentages being by weight based on the total composition weight.

The metallic nitrates employed in the explosive or propellant compositions of the present invention are nitrates of alkali metals. The preferred metallic nitrates are potassium nitrate and sodium nitrate. The metallic nitrates may be employed in particle sizes of about 200 microns or less, commercially available particle sizes being fully acceptable.

The metallic nitrates are generally employed in the compositions of this invention in amounts from about 45% to about 65% by weight based on the total composition weight. Preferably, the compositions of the invention contain about 50% to about 61% by weight metallic nitrate based on total composition weight. A particularly preferred composition in accordance with this invention contains 50% to 61% by weight potassium nitrate.

The explosive or propellant compositions of the present invention contain only a metallic nitrate and cellulose acetate. (A small amount of residual solvent is also present, but is not considered to be an "active ingredient" of the compositions.) Thus, the compositions contain the desired amount of metallic nitrate, the balance being cellulose acetate. The cellulose acetate acts as a fuel for the metallic nitrate oxidizer upon ignition of the composition.

The compositions of this invention have several significant advantages over black powder. For example, since cellulose acetate is soluble in various liquid acetates, the explosive or propellant is solvent processable, unlike black powder. The compositions of this invention have substantially reduced hazard properties relative to black powder due to sharply reduced dusting the total absence of sulphur, and the absence of charcoal which is a source of hydrogen. Furthermore, the metallic nitrate crystals in the compositions of this invention are "trapped" or enclosed in a matrix of nearly inert cellulose acetate which adds to the overall stability of the composition. Finally, the compositions of this invention would be Department of Transportation Class B (Solid) explosives requiring less stringent shipping restrictions than black powder.

The explosive or propellant compositions of the present invention may be prepared by the following general procedure:

1. Dry and grind (or screen) the metallic nitrate.
2. Dissolve the cellulose acetate in excess liquid acetate solvent.
3. Blend (mix) the metallic nitrate into the cellulose acetate/liquid acetate solution.
4. Adjust the percent solvent to control the viscosity of the propellant mass so that the propellant is a stiff extrudable paste.
5. Extrude into a strand shape using a conventional extrusion press.
6. Cut at the face of the extrusion press.
7. Tumble dry the cut propellant strand in forced, dry hot air (under about 212° F.). Vacuum drying may also be employed.
8. Glaze the strand with graphite (about 0.1% by weight).

The liquid acetate solvent used to prepare the cellulose acetate solution may be any liquid acetate which will dissolve the cellulose acetate but which will not dissolve the metallic nitrate. Preferred liquid acetates are the alkyl acetates such as amyl and ethyl acetate, ethyl acetate being particularly preferred.

The following examples are illustrative of the present invention and are not intended to limit it in any manner. Unless otherwise specified, all weight percentages in the examples and throughout this specification are based on total composition weight.

EXAMPLE 1

Explosive or propellant compositions in accordance with this invention are prepared from the ingredients listed in Table I and II below by the following process:

1. The metallic nitrate is dried and ground (or screened) to the desired particle size.
2. The cellulose acetate is dissolved in excess ethyl acetate.
3. The metallic nitrate is blended thoroughly into the cellulose acetate/ethyl acetate solution.
4. The percent ethyl acetate solvent is adjusted so that the propellant is a stiff, extrudable paste.
5. The resulting material is extruded into a strand shape using a conventional extrusion press.
6. The strand is cut at the face of the extrusion press.
7. The cut strand is tumble dried.
8. The resulting dried strand is glazed with graphite (about 0.1% by weight) to prevent static charges and, thereby, further reduce the hazards of handling.

TABLE I

| | FORMULA A | FORMULA B | FORMULA C |
|---|---|---|---|
| Wt. % $KNO_3$, balance cellulose acetate | 50% | 51% | 52% |
| Avg. gas molecular wt. | 21.13 | 21.51 | 21.91 |
| $T_v$, °K. | 2,116 | 2,135 | 2,153 |
| IMP, ft-lbf/lbm[a] | 278,620 | 276,035 | 273,257 |
| VIMP, ft-lbf/ft$^3$ [b] | 27,981,100 | 27,853,800 | 27,705,800 |

TABLE II

| | FORMULA D | FORMULA E | FORMULA F |
|---|---|---|---|
| Wt. % $NaNO_3$/balance cellulose acetate | 50% | 51% | 52% |
| Avg. gas molecular wt. | 21.77 | 22.13 | 22.50 |
| $T_v$, °K. | 2,355 | 2,376 | 2,396 |
| IMP, ft-lbf/lbm | 300,863 | 298,604 | 296,241 |
| VIMP, ft-lbf/ft$^3$ | 30,984,000 | 30,917,800 | 30,840,000 |

[a]IMP is Mass Impetus
[b]VIMP is Volumetric Impetus

In the above tables, the data provided (i.e., Avg. gas molecular wt., $T_v$, IMP and VIMP) are the results of computerized diagnostic calculations (computer simulations) based on the formulations of each composition and assuming a combustion chamber pressure of 1,000 psia.

The simulated data in the Tables clearly demonstrate that the compositions of this invention are more energetic that black powder which has a typical IMP of about 160,000 ft-lbf/lbm up to a theoretical maximum of about 226,000 ft-lbf/lbm. Much of the increased power per pound of the compositions of this invention comes from the lower avg. gas molecular wt. as compared to black powder. (Avg. gas molecular wt. for black powder is about 35 whereas that of the compositions of this invention is about 21-22).

Also, due to the presence of the metallic nitrate in the compositions of this invention, a burning rate exponent of zero (n=0.0) results in the presence of a cellulose derived fuel (cellulose acetate).

The improved ordnance devices of the present invention contain an igniter comprised of the explosive or propellant compositions of this invention. These ordnance devices include any explosive device such as ammunition, mines, grenades, artillery cartridges and the like which contain a primary explosive or propellant charge which is ignited or "set off" by an igniter composition. As used herein, the terms "igniter" and "igniter composition" refer to any composition or device containing such composition which is employed to ignite the primary explosive or propellant in the ordnance device. Such igniters include those parts of ordnance devices commonly referred to as fuze trains or boosters.

I claim:

1. An igniter composition having a burn rate exponent of about zero consisting essentially of about 45% to about 66% by weight of a metallic nitrate selected from the group consisting of potassium nitrate and sodium nitrate and about 34% to about 55% by weight of cellulose acetate.

2. A composition according to claim 1 containing about 50% to about 61% metallic nitrate.

3. A composition according to claim 1 wherein the metallic nitrate is $KNO_3$.

4. A composition according to claim 1 wherein the metallic nitrate is $NaNO_3$.

5. A composition according to claim 2 wherein the metallic nitrate is $KNO_3$.

6. A composition according to claim 2 wherein the metallic nitrate is $NaNO_3$.

7. In an ordnance device comprising a primary charge selected from the group consisting of propellants and explosives and an igniter charge for igniting said primary charge, the improvement wherein said igniter charge consists essentially of about 45% to about 66% by weight of a metallic nitrate selected from potassium nitrate and sodium nitrate, and about 34% to about 55% by weight of cellulose acetate, whereby said igniter charge has a burn rate exponent of about zero.

8. An ordnance device according to claim 7, wherein the igniter charge contains from about 50% to about 61% by weight of said metallic nitrate.

9. An ordnance device according to claim 7 wherein said metallic nitrate is potassium nitrate.

10. An ordnance device according to claim 7 wherein said metallic nitrate is sodium nitrate.

11. An ordnance device according to claim 8, wherein said metallic nitrate is potassium nitrate.

12. An ordnance device according to claim 8, wherein said metallic nitrate is sodium nitrate.

* * * * *